United States Patent [19]

Cosme

[11] Patent Number: 4,534,600

[45] **Date of Patent: * Aug. 13, 1985**

[54] DRAWER SLIDE ASSEMBLY

[76] Inventor: Peter A. Cosme, R.R. 1, Box 119, Lockport, Ill. 60441

[ * ] Notice: The portion of the term of this patent subsequent to Jun. 21, 2000 has been disclaimed.

[21] Appl. No.: 572,551

[22] Filed: Jan. 20, 1984

[51] Int. Cl.[3] ..... F16C 29/02

[52] U.S. Cl. ..... 308/3.6

[58] Field of Search ..... 308/3.6, 3 R, 3.8; 312/350, 341

[56] References Cited

U.S. PATENT DOCUMENTS

| | | | |
|---|---|---|---|
| 3,650,577 | 3/1972 | Gutner | 308/3.6 |
| 4,305,625 | 12/1981 | Gutner et al. | 308/3.6 |
| 4,389,079 | 6/1983 | Cosme | 308/3.6 |
| 4,449,766 | 5/1984 | Shook | 308/3.6 |

*Primary Examiner*—Lenard A. Footland

*Attorney, Agent, or Firm*—Samuel Lebowitz

[57] ABSTRACT

An improvement on my U.S. Pat. No. 4,389,079, granted June 21, 1983, for a DRAWER SLIDE ASSEMBLY applicable to case good generally, such as chests, desks, dressers, tables and other household furniture having a drawer. My invention is applicable to case goods formed of wood, metal, etc. My improved slide comprises a pair of interengaging male and female channel-like members that may conveniently be metal stampings, one affixed to the bottom of a drawer cavity while the other is attached to the drawer bottom and designed to ride in the first mentioned channel member. The male channel has affixed to its leading or rear end a slide or guide block preferably molded of synthetic plastic having a low coefficient of friction, serving to introduce the channel by which it is carried into the other channel and also serving as a low friction bearing for smooth sliding movement of the drawer.

11 Claims, 8 Drawing Figures

DRAWER SLIDE ASSEMBLY

My invention relates to household furniture of the class known in the trade as case goods, and has to do more particularly with drawer construction, and especially that part of the structure known as center-guide slides interconnecting a drawer and cavity of the case. While especially applicable to furniture formed principally or in part of wood or the like, it may also be found useful in metal or other kinds of furniture.

A major problem in the construction of case goods is the interfitting of drawers and cavities in such manner that the drawers will alide with a minimum of friction, wobble, wedging, etc., and maintain such easy action for the life of the piece.

BACKGROUND

From my long studies in this field, I am well aware that numerous attempts have been made to provide slides to facilitate drawer movement, some of which have found their way to the market. Those with which I am familiar have radical disadvantages.

Inasmuch as elimination of friction is a prime objective, movable anti-friction devices have been provided such as ball or roller bearings. They have proven quite unsatisfactory for a number of reasons. Thus, such bearings, being loose, tend to fall out and be lost in course of shipment or movement of the piece. Furthermore, lubricant has been found desirable or necessary, which tends to dry in time, becoming gummy and resulting in sticking and jamming of the drawer.

Furthermore, drawer slides of the prior art with which I am familiar are costly enough to discourage their use, largely because of multiplicity of parts.

The most pertinent prior art of which I am aware is my U.S. Pat. No. 4,389,079, dated June 21, 1983, and references cited therein.

BRIEF OUTLINE OF INVENTION

My improved slide construction as disclosed and claimed in my patent referred to hereabove, of which the present invention constitutes an improvement, contemplates male and female channel members preferably formed of metal stampings such as galvanized steel and attached respectively to the drawer bottom and cavity, said channels being proportioned for a minimum of play and mounted in opposed relation, with the web portion of each channel forming seats for mounting as by screws or the like on adjacent surfaces of drawer and cavity, respectively.

Of major importance is a guide or slide block preferably molded of low-friction synthetic resin, secured to the leading end of one of the channels to provide a guiding tongue in the introduction of one channel into the other when fitting a drawer into its cavity. After such introduction, made extremely facile by said molded block, the latter serves as a bearing to insure easy sliding movement, avoiding the aforesaid disadvantages of movable bearings.

The improvement herein disclosed and claimed provides a novel adjustability, to accommodate drawers of different depths, along with improved each of operation.

Other objects and advantages will become apparent to those skilled in the art as the description proceeds.

BRIEF DESCRIPTION OF DRAWINGS

Referring now to the drawings forming part of this specification and illustrating certain preferred embodiments.

DETAILED DESCRIPTION

Figures 1, 2:
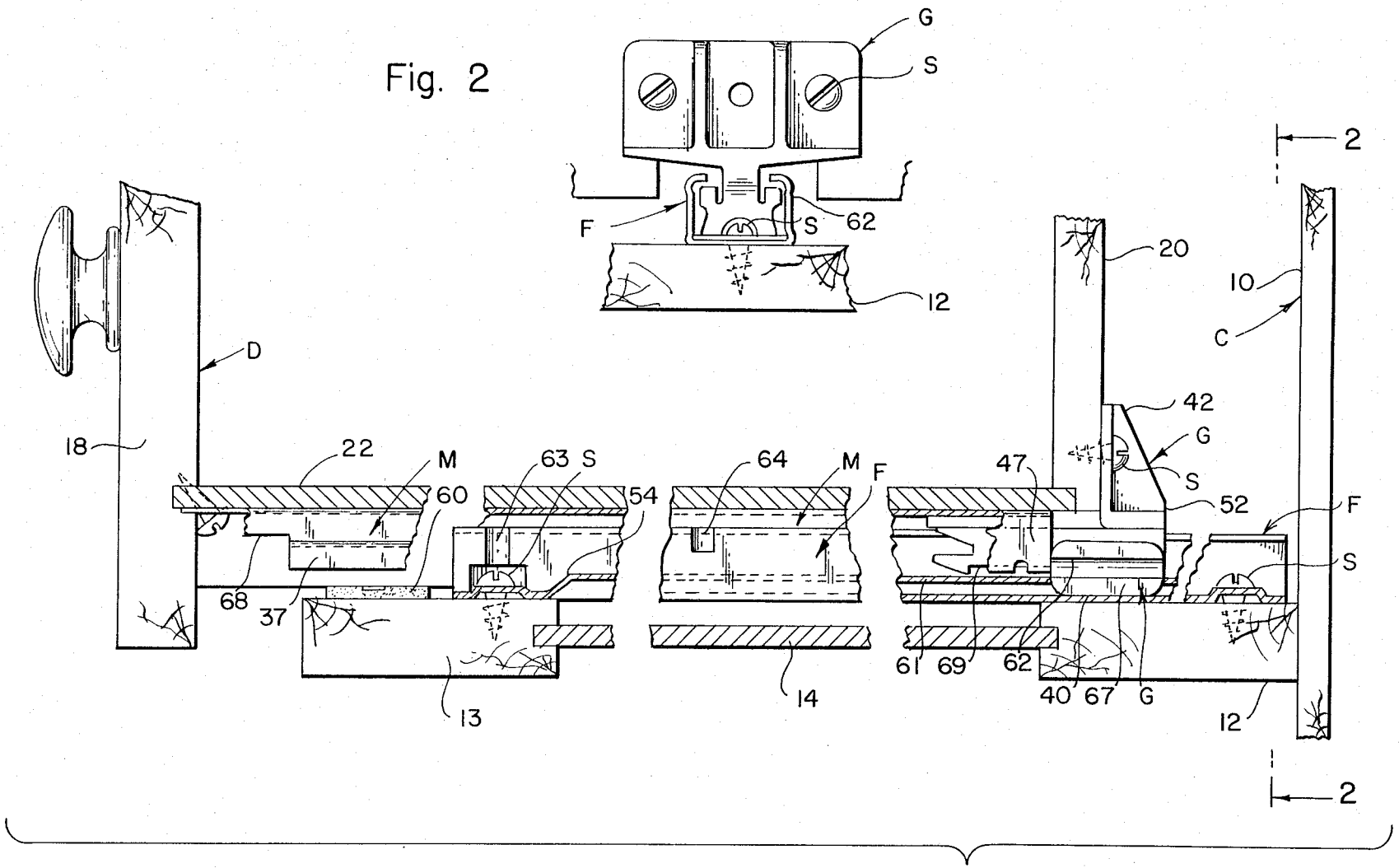
FIG. 1 is a fragmentary longitudinal view, partly in elevation and partly in section, of a drawer slide embodying my invention as applied to a drawer and cabinet, with parts broken away for added clearness.
FIG. 2 is a fragmentary transverse section taken substantially along line 2—2 of FIG. 1.

Reference character C indicates a cabinet or case of any type, in this instance constructed mainly or entirely of wood or other suitable material, having a vertical back wall member 10, horizontal members 12 and 13 that may be skeletal and which provides a support for a drawer indicated generally by character D.

Drawer D may be of standard or other suitable construction with a front vertical panel 18, a back vertical panel 20 and a horizontal bottom panel 22 for supporting whatever articles are to be housed in the drawer.

Secured to the top surface of support members 12 and 13 is a fixed guide member F which may be attached to the case by any suitable means such as wood screws S. Said screws extend through front and back elongated slots 51, so formed to permit adjustability.

Guide member F is generally of U-formation, with inwardly extending flanges 28—28 except at the forward end, where flanges 65—65 extend outwardly to permit insertion of a guide block to be described. On opposite sides of guide member F I provide inwardly extending deformations 64 to serve as stops.

Adjacent the forward end of member F are deformations 63, 63 serving as stiffeners as well as for controlling movement of the male guide member M, to minimize side-sway.

Said male member M and guide member F may be of galvanized or cold-rolled steel stampings or the like.

Slide M (FIG. 4) comprises a channel member terminating in a pair of spaced parallel vertical flanges 37, 37. The elements of the two channel members F and M are so proportioned that part M will nest snugly within part F with only sufficient vertical and horizontal play to prevent binding or jamming without the need for lubricant; in other words, having free sliding movement.

Affixed to the rear end of drawer slide member M is a guide/slide block G preferably molded of a suitable synthetic plastic resin such as polyethylene or polypropylene. Such synthetic resins and their particular anti-friction and other characteristics are well known in the art and especially with regard to their suitability as bearings in a great variety of anti-friction relationships. Such properties are utilized in my invention, where it is highly desirable that the parts be fitted with a minimum of wobble or jamming in normal movement of the drawer back and forth in the cavity.

Figure 4:
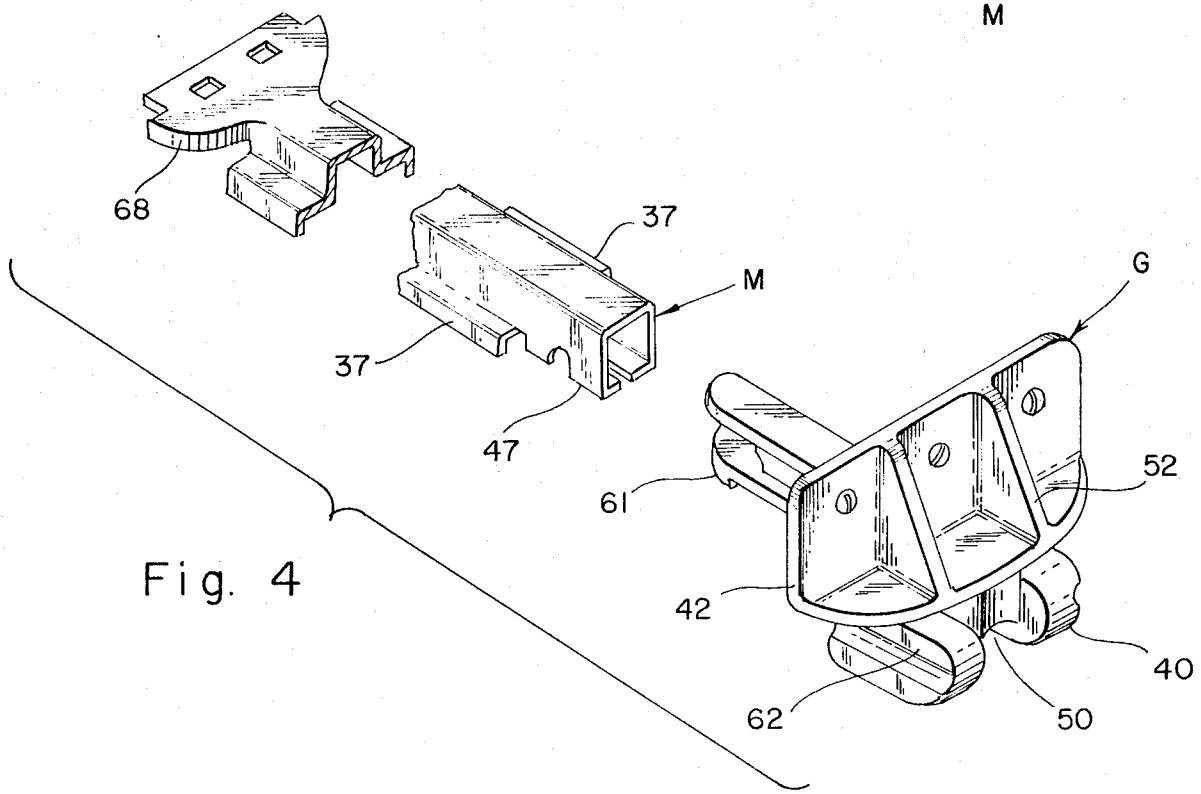
FIG. 4 is a fragmentary exploded perspective view of the male channel member.
Figure 6:
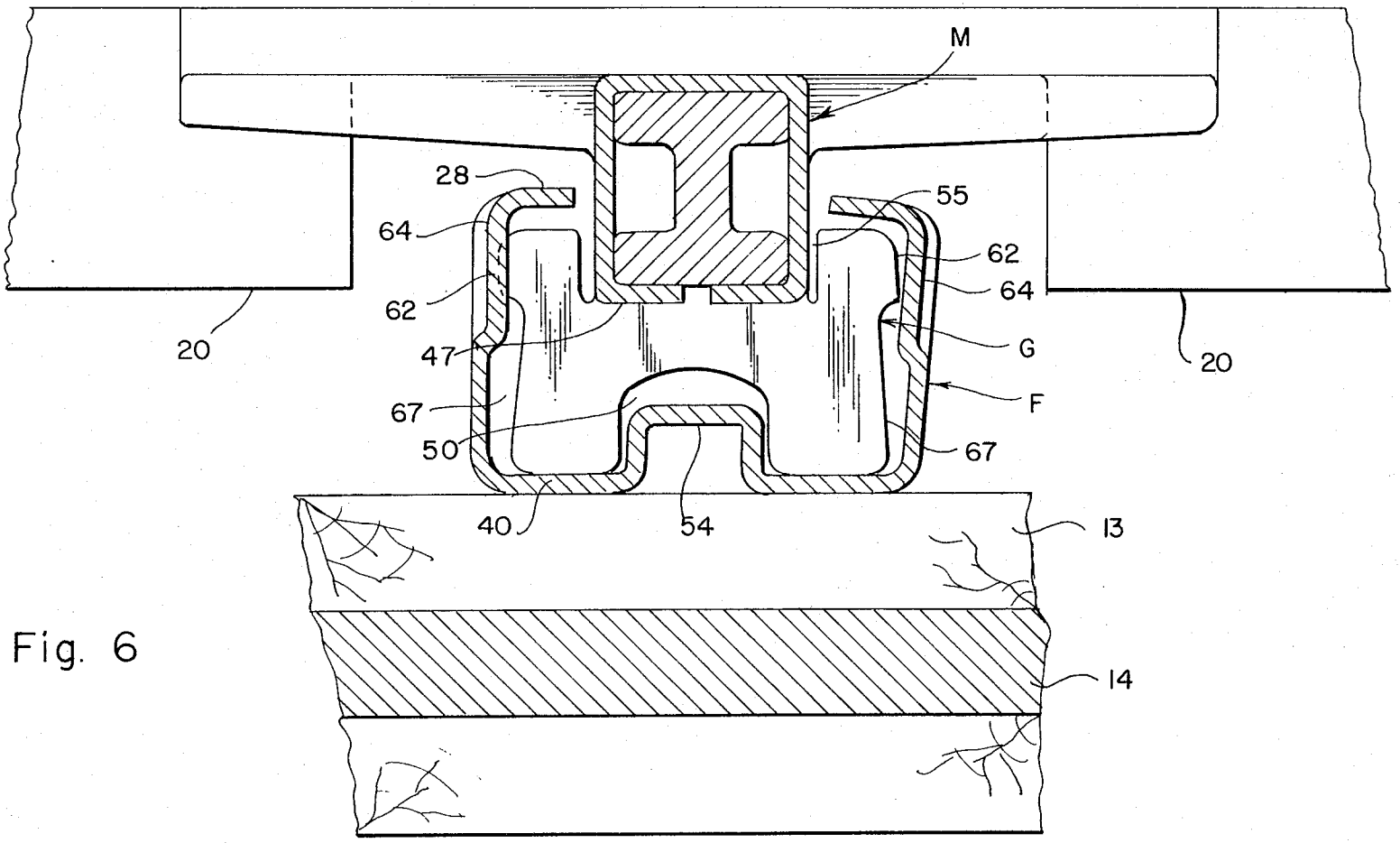
FIG. 6 is a sectional view along line 6—6 of FIG. 5, following its nesting within the female channel member.

As seen in FIG. 4, glide block G is an integrally molded member having a transverse bar portion 42 perforated to seat screws S for attachment to drawer panel 20. Stiffening bars 52 extend normally from bar portion 42 and serve as a sloping bridge between the latter affixed to the rear panel 20 of the drawer and the rear end of the guide block G.

Lugs 62 on each side glide block G override the stops and slide in the lateral passages of female channel member F on the opposite sides of the central guiding ridge 54 therein, to prevent abrupt jarring action in passing projections 64 on female member F. It should be noted that bearing surfaces 40 of glide block G effectively carry the load of the drawer D, riding on the lower faces of said passage in channel F.

The above-mentioned longitudinal, upwardly extending rib or ridge 54 on female guide F seats in the recessed area 50 of the glide block G to limit side-sway.

Figure 3:
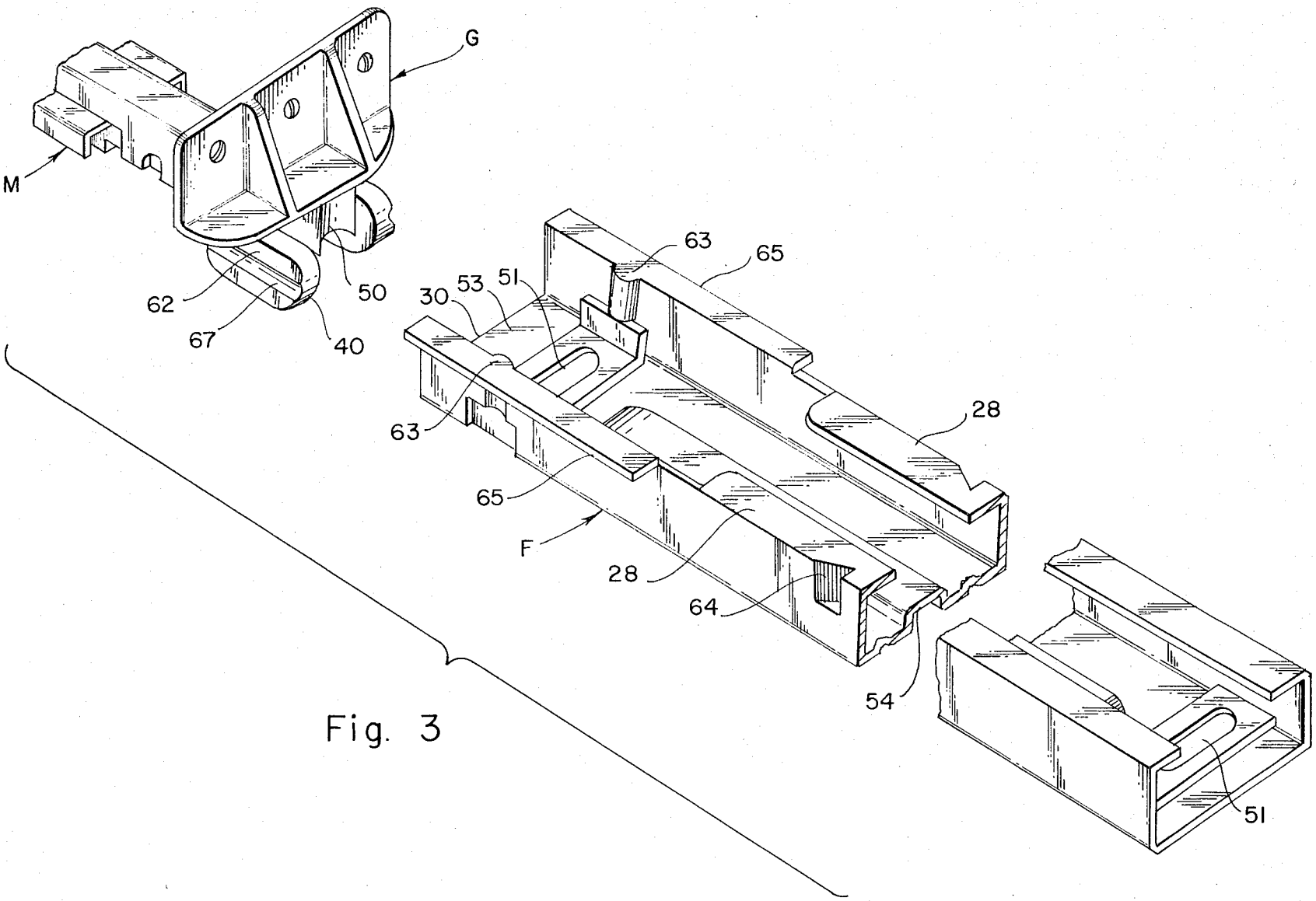
FIG. 3 is a fragmentary exploded perspective showing assembly operation in connection with one embodiment of my invention.
Figure 5:
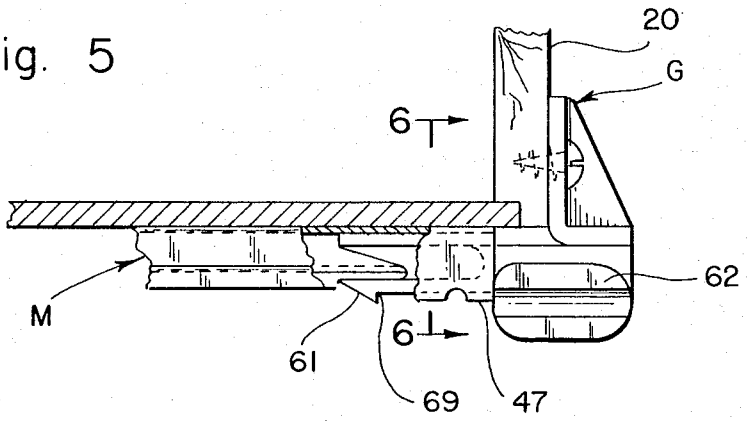
FIG. 5 is a front elevation, with some parts in section, of the right end of the male channel member shown in FIG. 4, following its attachment to the bottom of the drawer.

Extending forwardly from guide block G, is a bar member terminating in a locking tongue 61 designed to snap into rectangular guide portion 47, or crimped area, of male guide M to provide for a one piece assembly and permitting adjustability 69 for drawer-length variations. This adjustment capability is illustrated in FIGS. 1, 3 and 5. The forward portion 68 of said male member is secured to the drawer front 18, as by screws or staples.

Figure 7:
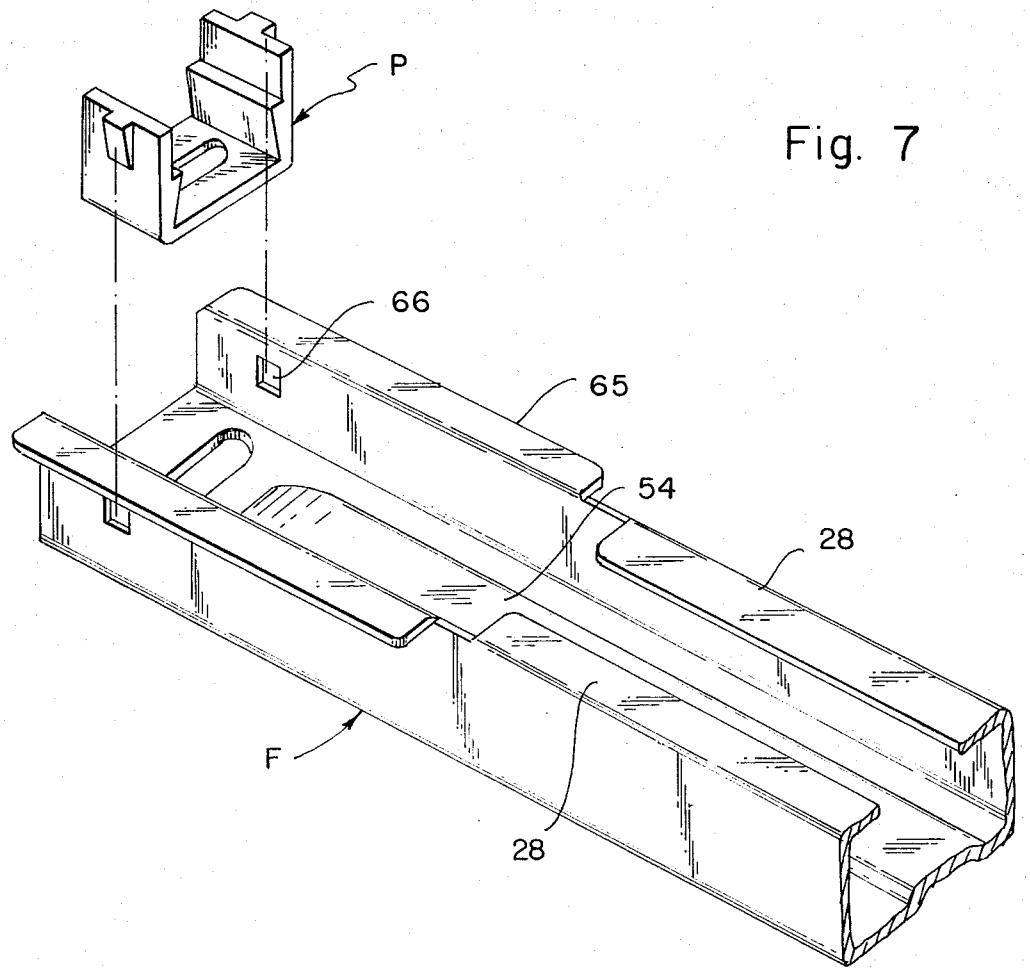
FIG. 7 is a fragmentary exploded perspective of parts of my improved slide, showing the female member in process of assembly with a "snap-in" low-friction pad.

FIG. 7 shows the snap-in friction pad P that eliminates metal to metal contact at the leading edge of the male and female members. The friction pad P snaps into slots 66 on the female guide F.

Figure 8:
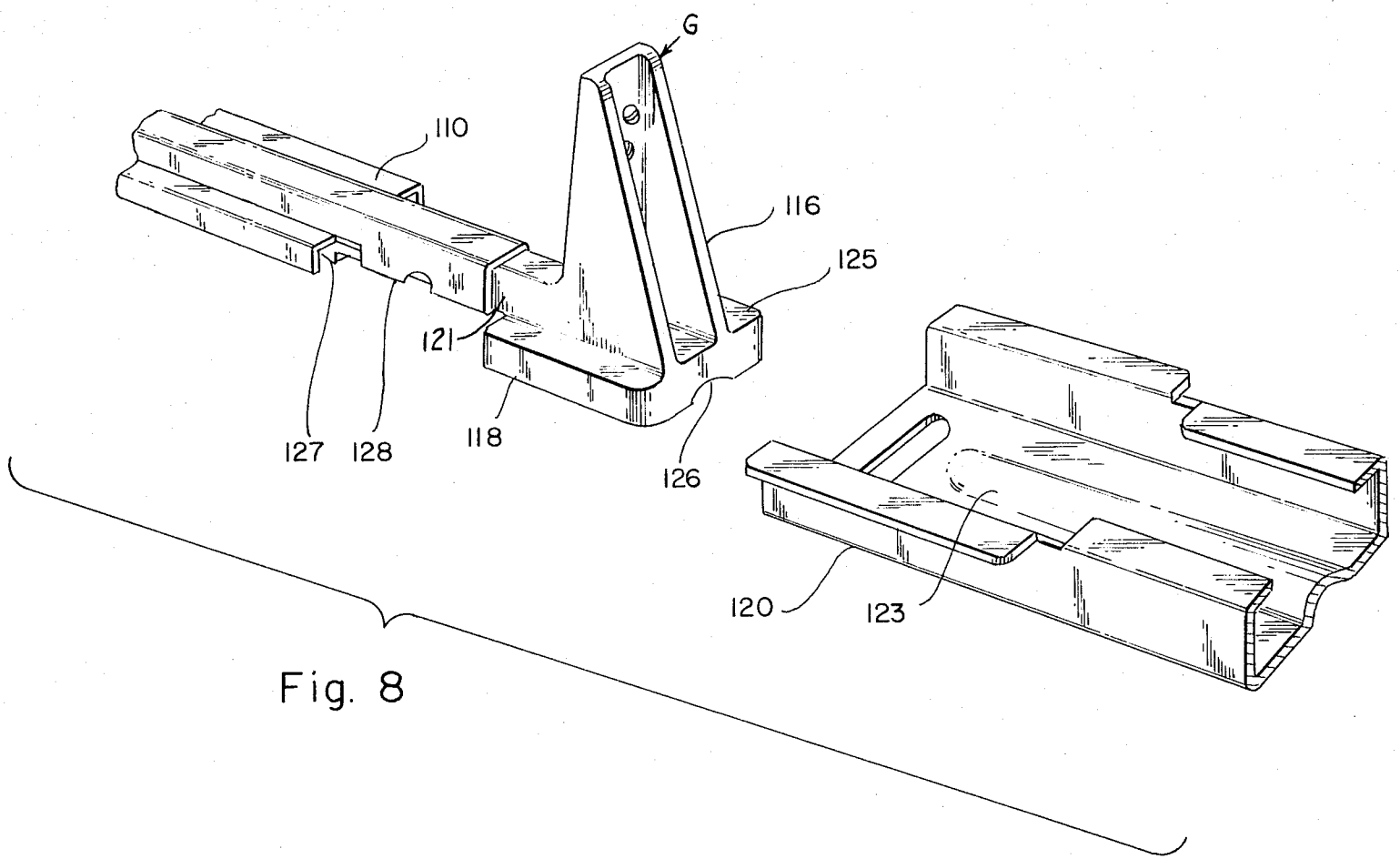
FIG. 8 is a perspective view of the adjacent interengaging ends of the male and female channel members of another embodiment of the invention adapted for use in a case with relatively shallow drawers.

In FIG. 8 is shown another embodiment of the invention as applied to another kind of case, such as one with relatively shallow drawers, which, for convenience, is referred to as a "low boy" version, utilizing the same principles as the embodiment previously described. The female channel 120 is provided with a central convexly-shaped ridge 123 for accommodating a similarly curved recess 126 in the base of the guide and slide member G. The vertical wall of the latter is adapted to be affixed to the rear wall of the drawer, and the bar member 121 projecting forwardly therefrom which terminates in tongue 127, is adapted to be inserted through the rear end of sleeve-like portion 128 of the male slide 110 until the tongue snaps into the front end of this portion, to connect the parts together with a limited capability of relative movement therebetween, as clearly shown in FIG. 8, to accommodate slight variations in length of the drawer. The sloping bridging member 116 from the vertical wall to the base of the guide, helps to direct the latter to the entry end of the fixed female channel 120. Thus, the sides of the base 118 and 125 are guided for sliding movement between the web and overlying flanges of the female channel.

It will be understood that the improved construction herein described may include any or all of the features and advantages disclosed in my aforesaid patent along with the additional improvements herein disclosed.

CONCLUSION

Various changes within the spirit of my invention may suggest themselves to those skilled in the art. Hence, I do not wish to be limited to the specific forms shown or uses mentioned except to the extent indicated in the appended claims.

I claim:

1. A drawer slide assembly for a cabinet having a cavity and a drawer slidably seated therein, comprising (a) a first channel member adapted to be affixed to a cavity wall and comprised of a bottom web and lateral walls extending normally therefrom and terminating, to a major extent longitudinally in inwardly extending flanges, said bottom web having a central longitudinally extending elevated ridge along the major length thereof, (b) a second channel member adapted to be affixed to a drawer for nesting and sliding movement within said first channel member and terminating at its leading rear end in a sleeve-like portion, (c) a low friction body comprising a vertical member adapted to be affixed to the rear wall of said drawer and a bar member projecting forwardly from said body and insertable within the rear end of said sleeve portion for limited relative movement therein, said body including a base portion having a longitudinally extending recess at the bottom thereof overlying said ridge in said first channel member, (d) lateral protuberances on the said base portion of said body on the opposite sides of said last-mentioned recess adapted for sliding movement within the spaces in said first channel member on the opposite sides of said ridge and between said web and flanges thereof, and (e) a sloping bridge extending from the rear end of said base portion to said vertical member to facilitate insertion of the rear end of said second channel member into the front end of said first channel member.

2. An assembly as set forth in claim 1, wherein the ridge in said first channel member is of rectangular section.

3. An assembly as set forth in claim 1, wherein the ridge in said first channel member is of a convex section.

4. An assembly as set forth in claim 1, wherein said inwardly extending flanges extending from the top of said lateral walls are disposed in overlying relation to said lateral protuberances on the base portion of said body.

5. An assembly as set forth in claim 1, wherein said rod member on said body is slightly resilient and is provided with a tongue at the front end thereof for insertion into the rear end of the sleeve portion and to be snapped and retained in engagement with the latter by said tongue.

6. An assembly as set forth in claim 1, wherein said first and second channel members are formed of sheet metal and said body at the rear end of the latter is rigid plastic material having a low coefficient of friction.

7. An assembly as set forth in claim 1, wherein said first channel member is provided with flanges of short length extending outwardly from the top of said lateral walls adjacent to the front ends of said inwardly extending flanges.

8. An assembly as set forth in claim 7, including a pad of low friction material having a bottom web and lateral walls extending upwardly therefrom, detachably engaging the lateral walls of said first channel member at the front portion thereof and below the level of said outwardly extending flanges.

9. An assembly as set forth in claim 8, wherein the bottom webs of said first channel member and pad are provided with a transverse elongated slot for permitting lateral adjustment of said channel member.

10. An assembly as set forth in claim 9, wherein the bottom web of said first channel member is also provided with a transverse elongated slot adjacent to its rear end for complementing the adjustment capability of said channel member.

11. An assembly as set forth in claim 1, wherein the lateral walls of said first channel member are provided with inwardly directed deformations adjacent to the front end thereof adapted to serve as stiffeners and to minimize side-sway of the drawer and channel attached thereto.

* * * * *